US005415102A

United States Patent [19]

White et al.

[11] Patent Number: 5,415,102

[45] Date of Patent: May 16, 1995

[54] MUZZLE LOADING SABOT

[76] Inventors: Gary B. White, P.O. Box 190; David A. Gumucio, 56 Georgia Circle (50-12), both of Roosevelt, Utah 84066

[21] Appl. No.: 242,177

[22] Filed: May 13, 1994

[51] Int. Cl.[6] ..... F42B 14/06

[52] U.S. Cl. ..... 102/522; 102/511; 102/532

[58] Field of Search ..... 102/511, 521–523, 102/532

[56] References Cited

U.S. PATENT DOCUMENTS

| | | | |
|---|---|---|---|
| 34,950 | 4/1862 | James | 102/522 |
| 36,879 | 11/1862 | Bird | 102/532 |
| 41,127 | 1/1864 | Smith | 102/522 |
| 1,746,397 | 2/1930 | Johnson | 102/522 |
| 3,164,092 | 1/1965 | Reed et al. | 102/522 |
| 4,175,493 | 11/1979 | Daily | 102/522 |
| 4,947,752 | 8/1990 | Richert | 102/430 |

FOREIGN PATENT DOCUMENTS

| | | | |
|---|---|---|---|
| 2606135 | 8/1977 | Germany | 102/520 |
| 9975 | of 1885 | United Kingdom | 102/532 |

OTHER PUBLICATIONS

Nonte, Jr., Firearms Encyclopedia, 1973 p. 34.

*Primary Examiner*—Harold J. Tudor
*Attorney, Agent, or Firm*—Workman, Nydegger & Seeley

[57] ABSTRACT

A sabot comprising a substantially cylindrical body having an outside diameter, a receiving end, and a loading end located opposite the receiving end. The outside diameter is complementary to the inside diameter of the rifled bore in which the sabot is positioned during use. Located between the receiving end and the loading end of the sabot is a partition. Formed at the receiving end is a mouth for a receiving chamber. The receiving chamber extends from the receiving end to the partition. Formed at the loading end is a lip for a cupped recess. The cupped recess extends from the loading end to the partition. Annularly disposed about the cylindrical body and positioned between the receiving chamber and the loading end is at least one lubricating groove.

11 Claims, 2 Drawing Sheets

MUZZLE LOADING SABOT

BACKGROUND

1. Field of the Invention

The present invention generally relates to a sabot. More particularly, the present invention relates to a plastic collar used to hold a single bullet during discharge from a muzzle loading rifle.

2. Background Art

A precursor of the modern rifle was the muzzle loader. Operation of a muzzle loader required one to first pour a defined quantity of black powder into a barrel. Next, a wad, typically a piece of cloth or leather, was tamped into the barrel compacting the powder and holding it secure. Finally, a lead ball was positioned on top of the wad. In this condition, the muzzle loader was ready to be fired. A piece of flint positioned on top of a hammer would ignite the powder causing the wad and lead ball to be discharged from the barrel. Although revolutionary for its time, the muzzle loader was extremely inaccurate and had minimal strength.

With the development of rifling being formed within the barrel, dramatic increases in the accuracy of the muzzle loader were discovered. Rifling, however, also increased the difficulty of loading the barrel. Rifling a barrel entails forming a plurality of grooves that are helically positioned along the length of the bore of the barrel. The portions of the bore between the grooves are known as lands.

The principle of rifling is to produce a spin on the projectile about its longitudinal axis as the projectile is discharged through the barrel. The spin produces a gyroscopic effect on the projectile, giving the projectile greater accuracy. However, for the lead ball to engage the rifling grooves in a muzzle loader, the lead ball must have a diameter slightly larger than the inside diameter of the muzzle bore. As the ball is pressed into the bore, the lead indents into the grooves. On discharge, the ball rotates following the grooves, thereby rotating the lead ball.

Although accuracy was increased, pressing the oversized lead ball the length of the barrel was a very strenuous and time consuming task. Furthermore, although it was known that a conical shaped bullet, as opposed to a ball, would be more aero-dynamic and produce a more accurate shot, the force required to position the bullet in the barrel deformed the conical nose of the bullet. As a result, the deformed bullet would have an erratic flight path.

With the invention of self-contained cartridges, muzzle loading became obsolete for conventional military and hunting uses. Nevertheless, the muzzle loader has continued to find favor with an ever-increasing group of purists who continue to use the muzzle loader for hunting and sport shooting. Although the principle of muzzle loading has remained relatively constant, the apparatus has improved in an attempt to alleviate past problems and improve the speed, distance and accuracy of the bullet.

To alleviate some of the previous problems with loading, a sabot was designed to replace the conventional wad. A sabot is a plastic sleeve that holds the bullet during discharge. The sabot typically comprise a cylindrical body having a receiving chamber accessible at a receiving end and a base at the other end. During operation, as before, the black powder is poured into the barrel. A bullet is then positioned within the receiving chamber of the sabot. Finally, the base of the sabot is pressed down the barrel, compacting the black powder.

In prior applications, the outside diameter of the sabot is normally slightly larger than the groove to groove diameter of the bore so that as the sabot is pressed into the barrel the sabot indents into the grooves of the rifling. Accordingly, as the powder is ignited, the sabot rotates in the rifling grooves during discharge, thereby simultaneously rotating the bullet. The sabot is useful in that the receiving chamber of the sabot can be made to fit any size or shape of bullet without having to change the barrel size or decrease the amount of black powder used. This is accomplished by varying the thickness of the walls of the receiving chamber.

Although it is easier to position a plastic sabot than a lead ball, the oversized plastic sabot still requires considerable effort and time to be pressed the length of the barrel. In fact, the amount of force required to position the sabot is so great that the ramrod will often deform the nose of soft, conical, lead bullets.

An additional problem associated with plastic sabots is that as the muzzle loader is discharged, the black powder leaves a rough, gritty residue on the wall of the barrel. As the muzzle loader is continually loaded and discharged, the gritty residue scrapes a portion of the plastic off the sides of the sabot forming a plaque on the wall of the barrel. In turn, this plaque increases the difficulty of loading the sabot and detrimentally affects the accuracy of the bullet shot.

The use of conventional sabots is also inadequate when firing higher velocity bullets. Discharging high velocity bullets from conventional sabots results in disruption of the sabots and irregular flight paths of the bullets. It is theorized that the combination of the mass of the bullet and the explosion of the black powder overcomes the strength of the sabot, causing the sabot to fail within the barrel. In turn, failure of the sabot results in an uneven force being applied to the bullet, thereby affecting the bullet's trajectory.

OBJECTS AND BRIEF SUMMARY OF THE INVENTION

It is, therefore, an object of the present invention to provide a sabot that can be easily positioned within a rifled barrel of a muzzle loader.

Another object of the present is to provide a sabot capable of communicating the spin of the rifling to the bullet as the sabot is discharged through the barrel.

It is a further object of the present invention to provide a sabot in which a soft lead conical bullet can be used without deformation during loading.

A still further object of the present invention is to provide a sabot with the strength to accurately discharge a high velocity bullet.

Yet another object of the present invention is to provide a sabot that will not form a plaque on the inside of the barrel during repeated shooting and loading of the muzzle loader.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

To achieve the foregoing objects and in accordance with the invention as embodied and broadly described herein a sabot is provided for holding a bullet within the barrel of a muzzle loader prior to discharge. The sabot comprises a substantially cylindrical body having an outside diameter, a receiving end, and a loading end located opposite the receiving end. Positioned between the receiving end and the loading end is a partition.

Formed at the receiving end is an opening to a receiving chamber. The receiving chamber extends from the receiving end to the partition and is sized to snugly hold the bullet prior to discharge. Also extending from the receiving end a distance toward the partition are a plurality of longitudinal slots that are equally spaced about the circumference of the opening. Formed between the slots are flexible leaves. The leaves spread apart upon discharge from the barrel, causing separation of the sabot from the bullet.

Formed at the loading end is a lip for a cupped recess. The cupped recess extends from the loading end to the partition and is pressed against the black powder prior to discharge.

Annularly disposed about the cylindrical body between the loading end and the receiving chamber are lubricating grooves. The lubricating grooves act as a reservoir for a lubricant. As the sabot is positioned within a barrel, the lubricant is evenly distributed along the wall of the barrel. In turn, the lubricant makes it easier to insert the sabot and softens the gritty residue of black powder that can build up on the inside of the barrel.

The sabot of the present invention is typically used in the bore of a muzzle loader having lands and grooves that are helically positioned along the length of the barrel. The inside diameter of the barrel is defined by the land to land diameter. One of the novel features of the present invention is that the outside diameter of the sabot is complementary to the land to land diameter of the gun barrel. Nevertheless, the sabot is able to engage the grooves to rotate the bullet upon discharge. As discussed later in greater detail, this is a result of the bullet expanding and pressing the sabot into the grooves of the bore.

BRIEF DESCRIPTION OF THE DRAWINGS

In order to completely understand the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are therefore not to be considered limiting of its scope, the invention will be described with additional specificity and detail through the use of the accompanying drawings in which.

DETAILED DESCRIPTION OF THE PREFERRED EMBODIMENTS

Figure 1:
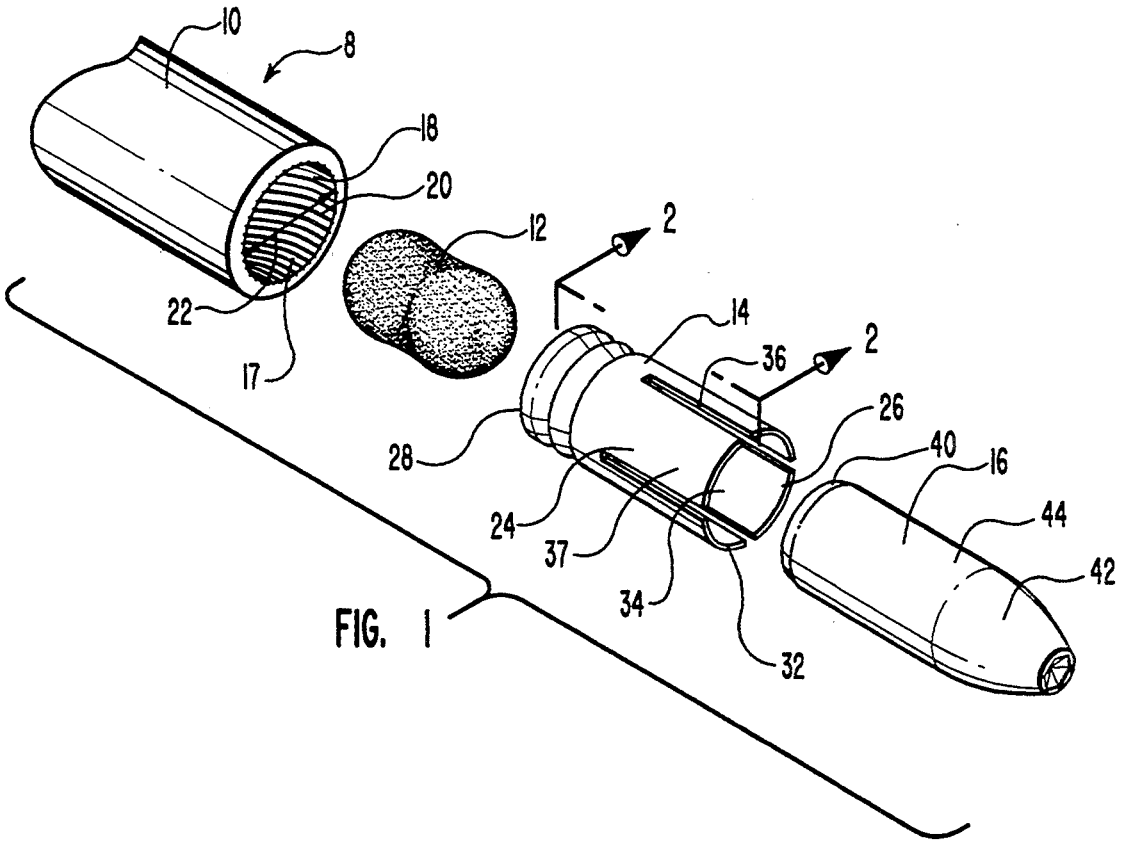
FIG. 1 is an exploded perspective view of the components used in discharging a muzzle loader including a barrel, black powder, sabot, and bullet.

Depicted in FIG. 1 is an exploded view of the components used in firing a muzzle loader 8. The components include a barrel 10, black powder 12, a sabot 14, and a bullet 16. Barrel 10 has a elongated bore 17 with lands 18 and grooves 20 that are helically positioned along the length of bore 17. The distance between opposing lands 18 is defined as an inside diameter 22 of bore 17. Initially, positioned within bore 17 is a defined quantity of black powder 12.

Positioned adjacent to black powder 12 is sabot 14. As shown in greater detail in FIG. 2, sabot 14 comprises a substantially cylindrical body 24 having an outside diameter 25, a receiving end 26, and a loading end 28 located opposite receiving end 26. Positioned between receiving end 26 and loading end 28 is a nonperforated partition 30. Sabot 14 can be made of a variety of soft plastics known in the art. By way of example and not by limitation, sabot 14 can be made of polypropolyene and more preferable polyethylene.

Formed at receiving end 26 is an opening 32 to a receiving chamber 34. Receiving chamber 34 extends from receiving end 26 to partition 30 and is used for holding bullet 16. Receiving chamber 34 can be sized to securely hold a bullet having a size in the range between about 22 caliber to about 58 caliber with about 30 caliber to about 50 caliber being more preferred. The length of receiving chamber 34 depends on the length of bullet 16 and can be determined by those skilled in the art. Also extending from receiving end 26 a distance toward partition 30 are a plurality of longitudinal slots 36 that are equally spaced about the circumference of opening 32. The portion of body 24 defined between slots 36 are herein referred to as leaves 37.

The length of slots 36 depend on the size of bullet 16 being discharged. By way of example and not by limitation, sabot 14 designed for discharging a high velocity bullet, e.g. 45 to 50 caliber, has slots 36 that extend approximately two-thirds of the length of receiving chamber 34. Accordingly, approximately one-third of receiving chamber 34, herein referred to as a closed chamber 39, contains no slots 36. Such a design is contrary to conventional sabots in which slots 36 extend all the way to partition 30. Nevertheless, sabots of the present invention can be made with grooves 36 extending all the way to partition 30 (See FIG. 3).

Closed chamber 39 serves to add strength to sabot 14. The strength is necessary when firing high velocity bullets to prevent sabot 14 from blowing apart prematurely during discharge and for holding the bullet more rigid and straighter when firing. These features increase the accuracy of the resulting shot.

In turn, slots 36 cannot be too short or they will not release bullet 16 after discharge from barrel 10. Upon discharge from barrel 10, leaves 37 catch against the air and spread open. The added air resistance against opened leaves 37 cause sabot 14 to disengage from bullet 16. The actual required length of slots 16 can be determined in light of the present disclosure by those skilled in the art.

Formed at loading end 28 is a lip 36 for a cupped recess 38. Cupped recess 38 extends from loading end 28 to partition 30. During loading of barrel 10, sabot 14 is pressed so that cupped recess 38 securely rests against black powder 12. It has long been believed that cupped recess 38 expands on discharge to engage grooves 20 and thereby assist in rotating sabot 14. Recent studies, however, have determined that cupped recess 38 may serve no such function and thus may be purely ornamental. Accordingly, sabot 14 of the present invention can be made either with or without cupped recess 38. In the embodiment where cupped recess 38 is not added, partition 30 is positioned at loading end 28.

Prior to insertion of sabot 14 into barrel 10, bullet 16, shown in FIG. 1, is selectively positioned within receiving chamber 34. Bullet 16 is shown having a base 40, a conical nose 42, and a shaft 44 extending between base 40 and conical nose 42. Bullet 16 and receiving chamber 34 are designed so that shaft 44 snugly fits within receiving chamber 34. Alternatively, bullet 16 and receiving chamber 34 can be designed to function in a complementary manner with any size or shape of bullet 16. Bullet 16 commonly used with sabot 14 of the present invention, typically comprise a high concentration of lead so as to be relatively soft. One preferred bullet 16 is the SUPERSLUG that can be purchased from White Systems, Inc. of Utah.

One of the novel features of the present invention is that outside diameter 25 of sabot 14 is complementary to inside diameter 22 of bore 17, thereby permitting easy insertion of sabot 14 into bore 17. Preferably, sabot 14 fits snugly within bore 17 but not so tight that sabot 14 has to indent into grooves 20 during loading. As a result, conical lead bullets can be used since the force needed to positioned the bullet is not sufficient for ramrod action to damage the shape of the bullet nose.

Even though the diameter of sabot 14 is complementary to bore 17, sabot 14 is still able to engage grooves 20 for rotating bullet 16 on discharge. As black powder 12 is ignited, the sudden force applied to sabot 14 and adjacent bullet 16 causes bullet 16 to compress and belly out, thereby pushing the walls of sabot 14 into grooves 20 of bore 17. Accordingly, as sabot 14 travels the length of barrel 10, the engagement between sabot 14 and grooves 20 cause sabot 14 to rotate and thereby rotate bullet 16.

As previously discussed, the design of inventive sabot 14 is distinguishable from prior art sabots in that the outside diameter of all previous sabots are larger than the inside diameter of the muzzle bore. This design results in the sabot being engaged with the barrel grooves upon loading but makes it very difficult to actually load the sabot.

Figure 3:
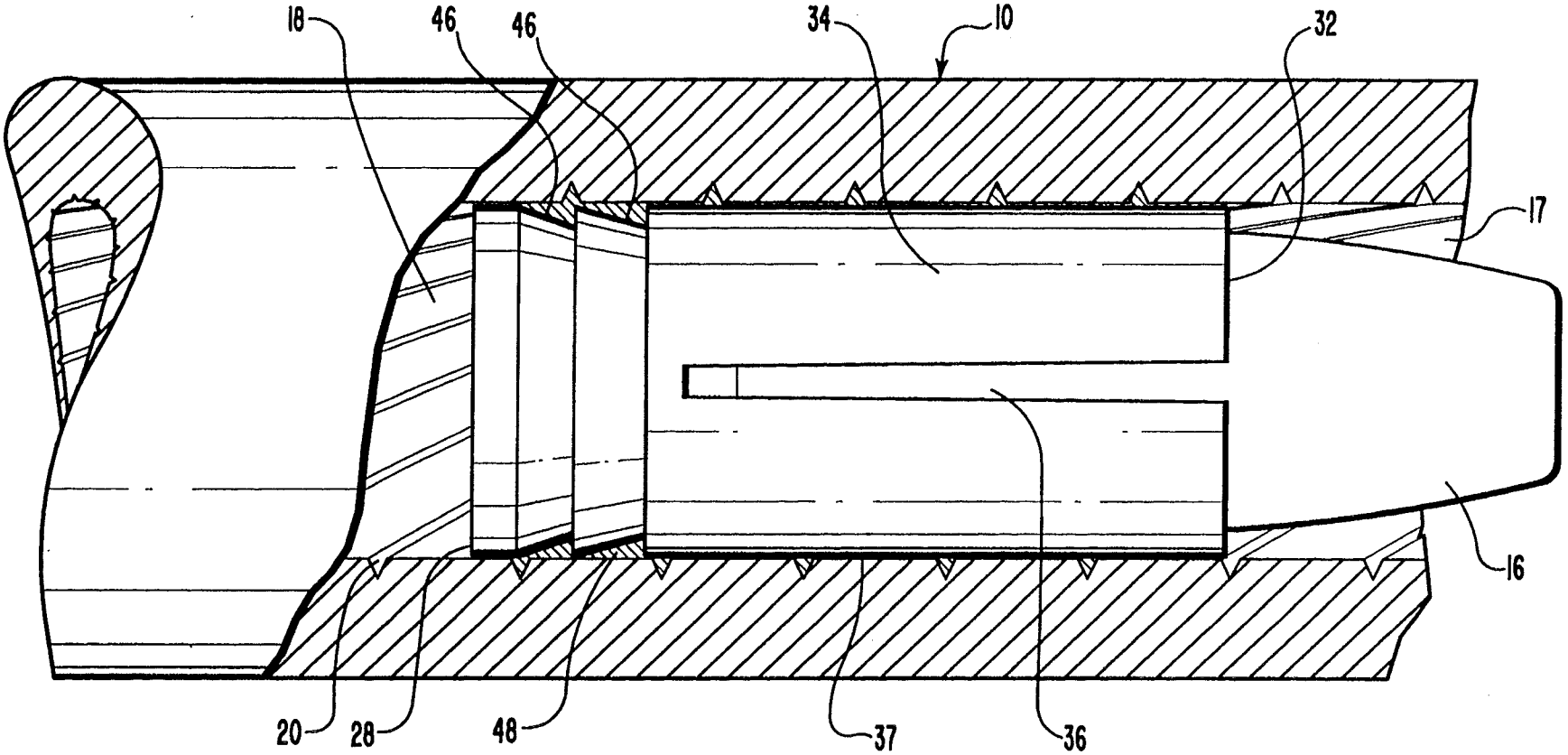
FIG. 3 is a cross-sectional view of a sabot having lubricating grooves and being positioned within a barrel.

As depicted in FIG. 3, another novel feature of the present invention is lubricating grooves 46 that are annularly disposed about cylindrical body 24 near loading end 28. As sabot 14 is discharged, black powder 12 leaves a gritty residue on bore 17. After repeated discharges of muzzle loader 8, the gritty residue acts like sand paper against sabot 14 causing a build-up on bore 17 from the plastic used to make the sabot.

To alleviate this problem, as shown in FIG. 3, a lubricant 48, can be applied to the sides of sabot 14. Lubricating grooves 46 act as a reservoir to evenly apply lubricant 48 on bore 17 as sabot 14 is loaded. Application of lubricant 48 serves to keep the black powder residue soft, thereby preventing scraping of sabot 14 and, accordingly, the formation of the build-up. Lubricant 48 also serves to provide a lubricated surface on which sabot 14 can ride during positioning, thereby increasing the ease with which sabot 14 can be positioned within barrel 10. Any of a variety of oils can be used for lubricant 48, however, a preferred lubricant 48 is SUPER-LUBE TM produced by White Systems, Inc. of Utah.

Figure 2:
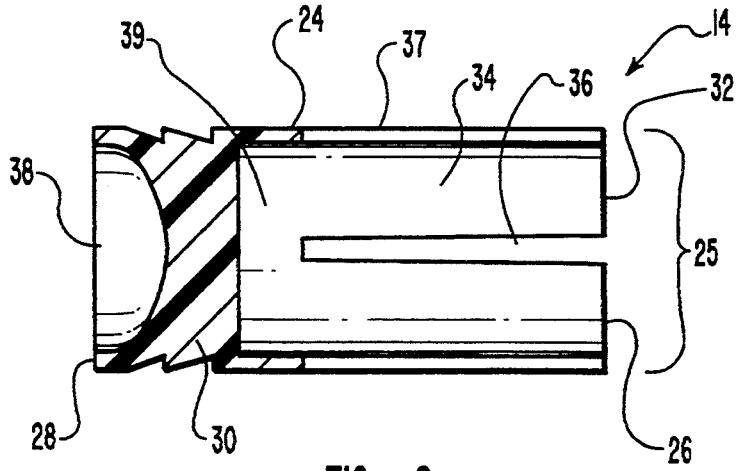
FIG. 2 is a cross-sectional view of the sabot shown in FIG. 1.

In the embodiment of sabot 14 shown in FIGS. 2 and 3, two lubricating grooves 46 are shown. Alternatively, however, sabot 14 may be formed with one or more lubricating grooves 46. Furthermore, although lubricating grooves 46 may be positioned over receiving chamber 34, in the preferred embodiment, lubricating grooves 46 are positioned over partition 30 and/or cupped recess 38. Positioning lubricating grooves 46 over receiving chamber 34 requires increasing the wall thickness of receiving chamber 34 so as to have enough material to form lubricating grooves 46. It is preferred to keep the wall thickness of receiving chamber 34 thin to insure that receiving chamber 34 can properly expand to fill grooves 20.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Patent is:

1. A muzzle loading sabot for holding a soft lead bullet within a gun barrel, the gun barrel having an elongate bore with lands and grooves helically positioned along the length of the bore, the bore having an inside diameter defined by the orthogonal distance between the lands, the sabot comprising:

a) a receiving end;

b) a loading end positioned opposite the receiving end;

c) a substantially cylindrical body extending between the receiving end and the loading end, the body having an outside diameter complementary to the inside diameter of the bore;

d) a nonperforated partition positioned within the cylindrical body at a position between the receiving end and the loading end; and e) a receiving chamber formed within the cylindrical body between the receiving end and the partition, the receiving chamber having an opening formed at the receiving end, the receiving chamber further including a plurality of leaves defined by a plurality of slots extending from the receiving end a distance toward the partition, the receiving chamber also being sized to receive the soft lead bullet without radial expansion of the cylindrical body and being sized to radially expand at least a portion of the cylindrical body into the grooves of the gun barrel upon firing of the soft lead bullet.

2. A muzzle loading sabot for holding a bullet within a gun barrel as defined in claim 1, wherein the sabot comprises a lubricating groove annularly disposed about the cylindrical body.

3. A muzzle loading sabot for holding a bullet within a gun barrel as defined in claim 1, wherein the sabot comprises a plurality of lubrication grooves annularly disposed about the cylindrical body.

4. A muzzle loading sabot for holding a bullet within a gun barrel as defined in claim 2, wherein the lubricating groove is positioned between the receiving chamber and the loading end.

5. A muzzle loading sabot for holding a bullet within a gun barrel as defined in claim 1, wherein the sabot is made of plastic.

6. A muzzle loading sabot for holding a bullet within a gun barrel as defined in claim 1, further comprising a cupped recess having a lip formed at the loading end, the cupped recess extending from the loading end to the partition and being axially aligned with the receiving chamber.

7. A muzzle loading sabot for holding a bullet within a gun barrel as defined in claim 1, the receiving chamber having a size for securely holding a bullet in a range from about 30 caliber to about 50 caliber.

8. A muzzle loading sabot for holding a soft lead bullet within a gun barrel, the gun barrel having an elongate bore with lands and grooves helically positioned along the length of the bore, the bore having an inside diameter defined by the orthogonal distance between the lands, the sabot comprising:

a) a receiving end;

b) a loading end positioned opposite the receiving end;

c) a substantially cylindrical body having an outside diameter complementary to the inside diameter of the bore;

d) a nonperforated partition positioned within the cylindrical body at a position between the receiving end and the loading end; and e) a receiving chamber formed within the cylindrical body between the receiving end and the partition, the receiving chamber having an opening formed at the receiving end, the receiving chamber further including a plurality of leaves defined by a plurality of slots extending from the receiving end a distance toward the partition, the receiving chamber also being sized to receive the soft lead bullet without radial expansion of the cylindrical body and being sized to radially expand at least a portion of the cylindrical body into the grooves of the gun barrel upon firing of the soft lead bullet;

f) a cupped recess having a lip formed at the loading end, the cupped recess extending from the loading end to the partition; and g) a lubricating groove annularly disposed about the body.

9. A muzzle loading sabot for holding a bullet within a gun barrel as defined in claim 8, wherein the sabot comprises a plurality of lubrication grooves annularly disposed about the cylindrical body.

10. A muzzle loading sabot for holding a bullet within a gun barrel as defined in claim 8, wherein the lubricating groove is positioned between the receiving chamber and the loading end.

11. A muzzle loading sabot for holding a bullet within a gun barrel as defined in claim 8, wherein the sabot is made of plastic.

* * * * *

UNITED STATES PATENT AND TRADEMARK OFFICE

CERTIFICATE OF CORRECTION

PATENT NO. : 5,415,102

DATED : May 16, 1995

INVENTOR(S) : GARY B. WHITE et al.

It is certified that error appears in the above-indentified patent and that said Letters Patent is hereby corrected as shown below:

Column 1, line 64, "The sabot typically comprise a" should be --The sabot typically comprises a--

Column 2, line 49, after "present" insert --invention--

Column 5, line 18, "comprise" should be --comprises--

Column 5, line 29, "positioned" should be --position--

Column 5, line 39, "cause" should be --causes--

Column 5, line 43, "are" should be --is--

Signed and Sealed this

Twenty-sixth Day of March, 1996

Bruce Lehman

*Attest:*

BRUCE LEHMAN

*Attesting Officer*

*Commissioner of Patents and Trademarks*